United States Patent [19]

Juntunen

[11] Patent Number: 4,893,764

[45] Date of Patent: Jan. 16, 1990

[54] COMPONENT REEL

[75] Inventor: Timothy J. Juntunen, Little Canada, Minn.

[73] Assignee: Minnesota Mining and Manufacturing Company, Saint Paul, Minn.

[21] Appl. No.: 204,676

[22] Filed: Jun. 9, 1988

[51] Int. Cl.[4] ..... B65H 75/14

[52] U.S. Cl. ..... 242/71.9; 242/71.8; 242/77

[58] Field of Search ..... 242/74, 71.8, 118.4, 242/118.6, 118.7, 118.61, 116, 115, 55, 68, 71.9, 118.5, 73, 77; 338/79

[56] References Cited

U.S. PATENT DOCUMENTS

| | | | |
|---|---|---|---|
| 2,860,215 | 11/1958 | Williams | 338/79 |
| 3,948,458 | 4/1976 | Beck et al. | 242/118.7 |
| 4,101,095 | 7/1978 | Carter | 242/115 |
| 4,253,570 | 3/1981 | O'Connor et al. | 242/118.7 X |
| 4,412,661 | 11/1983 | Wise et al. | 242/118.7 X |
| 4,445,649 | 5/1984 | Yataki et al. | 242/118.7 X |
| 4,516,737 | 5/1985 | Gliwa et al. | 242/74 X |
| 4,607,806 | 8/1986 | Yealy | 242/118.7 X |
| 4,702,429 | 10/1987 | Black | 242/71.8 |

*Primary Examiner*—Donald Watkins

*Attorney, Agent, or Firm*—Donald M. Sell; Walter N. Kirn; William L. Huebsch

[57] ABSTRACT

A reel adapted to carry a helically wound packaging tape comprising a carrier tape having spaced pockets containing components along its length and at least one cover tape adhered over the pockets to enclose the components. The reel includes a cylindrical hub of a resiliently flexible material; two circular flanges of greater rigidity and substantially larger diameter than the hub positioned coaxially along opposite side surfaces of the flanges; and rivets fastening the flanges together through the hub and compressing the hub for providing a predetermined dimension for the reel axially of the hub and flanges.

10 Claims, 1 Drawing Sheet

COMPONENT REEL

BACKGROUND OF THE INVENTION

1. Field of the Invention

This invention relates to reels adapted to carry helically wound packaging tapes comprising elongate carrier tapes having spaced pockets containing components along their lengths, and cover tapes adhered over the pockets to enclose the components.

2. Background

Reels are known that are adapted to have such packaging tapes helically wound on them (the combination being often called "tape and reel") and used on automated or semi-automated component application equipment. Such reels have been made of rigid paper or polymeric material which provide little cushioning or shock resistance for the packaging tapes or components. While reels of the known types could be made of more flexible materials to provide such cushioning, the industry tolerance standards for such reels can not be easily met if such flexible materials were used.

SUMMARY OF THE INVENTION

The present invention provides a reel adapted to carry a helically wound packaging tape of the type comprising an elongate carrier tape having spaced pockets containing components along its length and at least one cover tape adhered over the pockets to enclose the components, which reel both provides cushioning and shock resistance for the carrier tape and components in the packaging tape wound around the reel, and can reliably be made to the tolerance standards in the industry for such reels.

According to the present invention there is provided a reel adapted to carry such helically wound packaging tape, which reel comprises a generally cylindrical hub of a resiliently flexible material (e.g., a polymeric material such as expanded polyethylene or polystyrene); two circular flanges of a material having greater rigidity than the hub material (e.g., a polymeric material such as high density polyethylene or polypropylene corrugated sheet material) having substantially larger diameters than the hub which are positioned coaxially along opposite side surfaces of the hub, and means (e.g., spaced rivets) fastening the flanges together through the hub and compressing the hub to provide a predetermined axial reel dimension.

The reel can be made by providing the hub and flanges with thicknesses such that the total of the axial dimensions of the hub and flanges are slightly greater than the desired axial dimension of the reel; positioning the flanges coaxially along opposite side surfaces of the flanges; and fastening the flanges together through the hub to compress the hub and provide the desired axial dimension for the reel.

Additionally the hub of the reel can have a slot opening through its periphery and side surfaces adapted to receive an end portion of the packaging tape so that compression of the resiliently flexible hub material caused by inserting the end portion of the packaging tape into the slot will cause the end portion to embed in the hub material and retain the end portion of the packaging tape in the slot, and the flexibility of the hub material adjacent the slot will provide a relatively smooth support surface for the wrap of packaging tape directly over the end portion of the packaging tape where it exits the slot.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
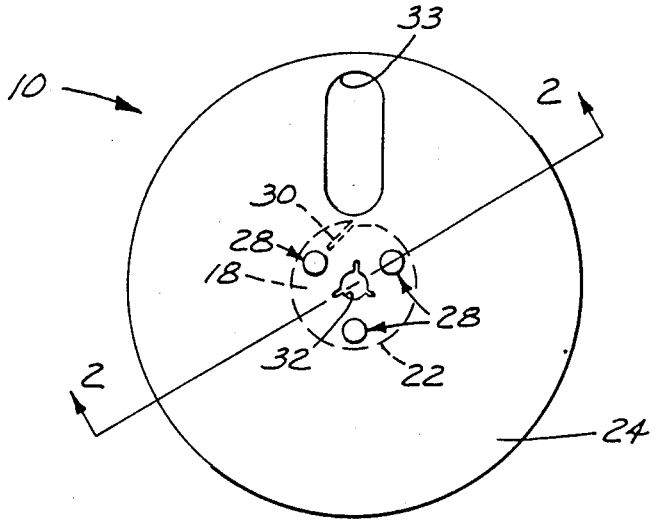
FIG. 1 is a side view of a reel according to the present invention.
Figure 2:
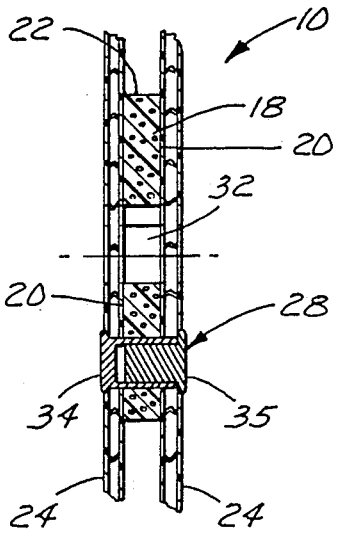
FIG. 2 is a fragmentary sectional view taken approximately along line 2—2 of FIG. 1.

Referring now to the drawing, there is shown a reel according to the present invention generally designated by the reference numeral 10.

Figure 3:
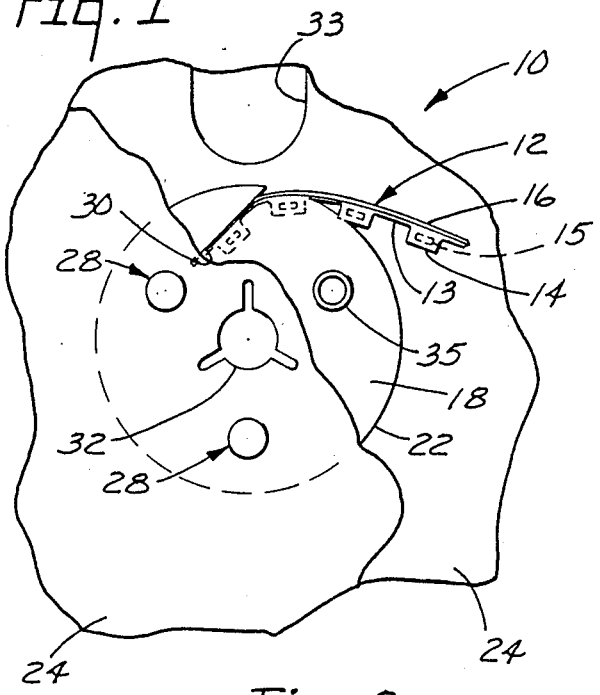
FIG. 3 is a fragmentary side view, partially in section of the reel of FIG. 1 having a short length of packaging tape attached thereto.

The reel 10 is adapted to carry a helically wound packaging tape 12 of the type illustrated in FIG. 3 comprising an elongate polymeric carrier tape 13 having spaced holes along one edge (not illustrated) adapted to be engaged by a drive sprocket and embossed along its length with spaced generally rectangular spaced pockets 14 containing components 15 (e.g., electrical components such as resistors, capacitors or semiconductors); and an elongate cover tape 16 adhered to the tape 13 over the pockets 14 to enclose the components 15. Alternatively, the reel could carry a packaging tape of the type (not illustrated) comprising an elongate relatively thick carrier tape having spaced holes adapted to be engaged by a drive sprocket along one edge and having through openings along its length defining pockets and containing components; and two elongate cover tapes, one adhered along each side of the carrier tape over an open side of the pockets to enclose the components.

The reel 10 comprises a generally cylindrical hub 18 of a resiliently flexible material (e.g., expanded polyethylene or polystyrene) having an axis, side surfaces 20 at right angles to its axis, and a peripheral surface 22 about which the packaging tape 12 is wound; two circular flanges 24 of material having greater rigidity than the hub material (e.g., high density polyethylene or polypropylene corrugated sheet material) each having an axis, having opposite major side surfaces, being of substantially larger diameter than the hub 18, and being positioned coaxially along opposite side surfaces 20 of the hub 18; and means in the form of three rivets 28 fastening the flanges together through the hub 18 and axially compressing the hub 18 to provide a predetermined dimension for the reel 10 axially of the hub 18 and flanges 24.

The hub 18 has a slightly arcuate slot 30 opening through its periphery 22 and side surfaces 20 and disposed at about a 45 degree angle to a tangent to the periphery of the hub 18 at the outlet opening of the slot 30, which slot 30 is adapted to receive an end portion of the packaging tape 12 so that compression of the resiliently flexible hub material caused by inserting the end portion of the packaging tape 12 in the slot 30 will cause the pockets 14 along the end portion to partially embed in the hub material to retain the end portion in the slot 30. An end portion of the alternate packaging tape described above comprising an elongate relatively thick carrier tape having through openings along its length defining pockets and containing components with two elongate cover tapes to enclose the components will also be held in the slot 30 by friction between the end portion and the hub material. Also, the flexibility of the hub material adjacent the slot 30 will provide a relatively smooth support surface for the wrap of packaging tape directly over the end portion of the packaging tape where it exits the slot 30.

The reel 10 has an industry standard coaxial central opening 32 including a circular portion from which three equally spaced slots radially extend to afford driving engagement with the reel by a driven shaft in the opening 32. Also, the flanges 24 both have aligned radially extending viewing and access openings 33 adjacent the slot 30 that allow a user to view the amount of packaging tape 12 that remains wound on the reel 10 and to affix the end portion of the packaging strip 12 to the hub 18 by inserting it into the slot 30.

The reel 10 can be made by providing the hub 18 and the flanges 24 so that they have total axial dimensions that are slightly greater (e.g., by 0.001 to 0.3 centimeter (0.001 to 0.12 inch)) than the desired axial dimension of the reel 10 to be formed; positioning the flanges 24 coaxially along opposite side surfaces 20 of the hub 18; and fastening the flanges 24 together through the hub 18 to compress the hub 18 and provide the desired axial dimension for the reel 10. Preferably this fastening step includes providing the three rivets 28 extending axially through the flanges 24 that are equally spaced from the axis of the reel 10 to define a rivet circle and are equally spaced around the rivet circle, which rivets 28 include portions 34 and 35 (e.g., a hollow tubular headed portion 34 and a solid cylindrical headed portion 35) adapted to be frictionally telescoped or pressed together axially of the flanges 24; and pressing the rivet portions 34 and 35 together under controlled conditions until the desired compression of the hub and axial dimension of the reel 10 is achieved.

As an example, with a 3 inch diameter, $\frac{3}{8}$ inch thick cylindrical hub 18 of expanded polyethylene (i.e., 4 to 9 pound per cubic foot expanded polyethylene, 4 pound per cubic foot being more easily compressed to a desired tolerance and 9 pound having better structural integrity), 12 and $\frac{7}{8}$ inch diameter, 3/32 inch thick flanges 24 of high density polyethylene corrugated sheet material (i.e., 130 pound per 1000 square feet polyethylene corrugated sheet material) and aluminum rivets 28 having a major diameter of $\frac{1}{4}$ inch, head diameters of $\frac{3}{8}$ inch, and with portions 34 and 35 of the type described above that press together to provide a 50 pound pull out force, the hub 18 can reliably be compressed by about 0.03 inch to an axial dimension of about 0.345 inch that reliably meets the industry standard tolerances as set forth in the American National Standards, Specification 481, revision A, page 10, available from Electronics Industries Association, Engineering Department, 2001 Eye Street N.W., Washington D.C. 20006, the content whereof is incorporated herein by reference.

The present invention has now been described with reference to a single embodiment thereof. It will be apparent to those skilled in the art that many changes can be made in the embodiment described without departing from the scope of the present invention. For example, for some purposes the hub and or flanges may be made of paper having the properties set forth above. Thus the scope of the present invention should not be limited to the structures described in this application, but only by structures described by the language of the claims and the equivalents of those structures.

I claim:

1. A reel adapted to carry a helically wound packaging tape comprising a carrier tape with spaced pockets containing components along its length and at least one cover tape adhered over the pockets to enclose the components, said reel comprising:

a generally cylindrical hub of a resiliently flexible material, having an axis, side surfaces at right angles to said axis, and a peripheral surface;

two circular flanges of a material having greater rigidity than said hub each having an axis, having opposite major side surfaces, being of substantially larger diameter than said hub, and being positioned coaxially along opposite side surfaces of said hub; and means fastening said flanges together through said hub and axially compressing said hub for providing a predetermined dimension for said reel axially of said hub and flanges, said means comprising a plurality of spaced rivets extending axially through the flanges, each of said rivets including a hollow tubular portion and a cylindrical portion frictionally engaged in said tubular portion a distance sufficient to provide the desired axial dimension for the reel.

2. A reel according to claim 1 wherein said hub has a slot opening through said periphery and said side surfaces of the hub and disposed at about a 45 degree angle to a tangent to said periphery at the outlet opening to the slot through said periphery, said slot being adapted to receive an end portion of the packaging tape so that compression of said resiliently flexible hub material caused by inserting the end portion of the packaging tape tape in the slot will retain the end portion in the slot.

3. A reel according to claim 1 wherein said rivets are spaced equally from said axis on a rivet circle, and are equally spaced around said rivet circle.

4. A reel according to claim 1 wherein both said hub and said flanges are of polymeric material.

5. A reel according to claim 1 whereins aid hub is axially compressed by up to 0.3 centimeter (0.11 inch) by said rivets fastening said flanges together through said hub.

6. A reel according to claim 1 wherein said hub is of expanded polyethylene or polystyrene.

7. A reel according to claim 1 wherein said flanges are of high density polyethylene or polypropylene corrugated sheet material.

8. A method for making a reel adapted to carry a helically wound packaging tape comprising a carrier tape having equally spaced pockets containing components along its length and at least one cover tape adhered over the pockets to enclose the components, said method comprising:

providing a generally cylindrical hub of a resiliently flexible material, having an axis, side surfaces at right angles to its axis, and a peripheral surface; and two circular flanges of a material having greater rigidity than the hub each having an axis, having opposite major side surfaces, and being of substantially larger diameter than the hub, the total of the axial dimensions of the hub and flanges being greater than the desired axial dimension of the reel;

positioning the flanges coaxially along opposite side surfaces of the flanges; and fastening the flanges together through the hub to compress the hub and provide the desired axial dimension for the reel, said fastening step includes the steps of:

providing a plurality a plurality of spaced rivets extending axially through the flanges and including a hollow tubular portion and a cylindrical portion adapted to be frictionally pressed together axially of the flanges with the cylindrical portion in the tubular portion, and pressing the rivet portions together a distance sufficient to provide the desired axial dimension for the reel.

9. A method according to claim 8 further including the step of:

cutting a slot in the hub opening through its periphery and side surfaces and disposed at about a 45 degree angle to a tangent to the periphery of the hub at the outlet opening to the slot through the periphery, which slot is adapted to receive an end portion of the packaging tape so that compression of the resiliently flexible hub material caused by inserting the end portion of the packaging tape tape in the slot will retain the end portion in the slot.

10. A method according to claim 8 wherein said fastening step axially compresses the hub by up to 0.3 centimeter (0.11 inch).

* * * * *